US008444239B2

(12) United States Patent
Gossens et al.

(10) Patent No.: US 8,444,239 B2
(45) Date of Patent: May 21, 2013

(54) OFFSET WEIGHT SUPPORTING SLIDE

(75) Inventors: Caleb Gossens, Anderson, SC (US); Jeremy Van Hill, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 13/459,865

(22) Filed: Apr. 30, 2012

(65) Prior Publication Data

US 2012/0211620 A1 Aug. 23, 2012

Related U.S. Application Data

(62) Division of application No. 12/200,035, filed on Aug. 28, 2008, now Pat. No. 8,182,056.

(60) Provisional application No. 60/970,047, filed on Sep. 5, 2007.

(51) Int. Cl.
*A47B 96/02* (2006.01)

(52) U.S. Cl.
USPC ..... 312/408

(58) Field of Classification Search ..... 312/401, 312/408, 410, 245, 351; 108/106, 108, 137; 62/382, 62/440, 441, 465; 126/337 A, 337 R, 339; 211/87.01, 211/90.01, 134, 153; 248/235, 241
See application file for complete search history.

(56) References Cited

U.S. PATENT DOCUMENTS

| | | | | |
|---|---|---|---|---|
| 1,341,829 | A | 6/1920 | Whittinghill | |
| 2,287,611 | A | 6/1942 | Harbison | |
| 2,719,772 | A | 10/1955 | Petkwitz | |
| 3,679,274 | A | 7/1972 | Nance | |
| 3,859,932 | A * | 1/1975 | Armstrong et al. | 108/75 |
| 4,131,203 | A | 12/1978 | Bridges | |
| 4,138,175 | A | 2/1979 | Tattershall | |
| 4,720,069 | A | 1/1988 | Bessinger | |
| 5,004,302 | A * | 4/1991 | Stocking et al. | 312/408 |

(Continued)

FOREIGN PATENT DOCUMENTS

| | | |
|---|---|---|
| DE | 29807540 | 6/1998 |
| DE | 10154274 | 5/2003 |

(Continued)

OTHER PUBLICATIONS

International Search Report for PCT/US2008/075098, dated Jul. 3, 2009, 2 pages.

*Primary Examiner* — James O Hansen

(74) *Attorney, Agent, or Firm* — Pearne & Gordon LLP

(57) ABSTRACT

An appliance is provided that includes a storage compartment with a shelf within the storage compartment. A support apparatus is configured for supporting the shelf. The support apparatus can include a first support, a second support, three track surfaces and three bearings. The first support is configured to be attached to an interior wall of the storage compartment. Each of the track surfaces is located on the first support. The second support is configured to engage the first support by the bearings of the second support being received within a respective track surface located on the first support. The shelf can be attached to the second support of the support apparatus. The shelf and the second support are movable into a plurality of positions relative to the interior wall of the storage compartment by a movement of the shelf with respect to the track surfaces located on the first support.

7 Claims, 4 Drawing Sheets

U.S. PATENT DOCUMENTS

| | | | | |
|---|---|---|---|---|
| 5,228,579 | A | 7/1993 | Kaufman | |
| 5,403,083 | A | 4/1995 | Dasher et al. | |
| 5,445,452 | A | 8/1995 | Kauffman et al. | |
| 5,642,924 | A | 7/1997 | Wohlrab et al. | |
| 5,692,817 | A | 12/1997 | Jun et al. | |
| 5,769,520 | A | 6/1998 | Jun et al. | |
| 5,803,274 | A * | 9/1998 | Scheveloff | 211/87.01 |
| 2007/0252498 | A1 | 11/2007 | Wing | |

FOREIGN PATENT DOCUMENTS

| | | |
|---|---|---|
| EP | 0407742 | 1/1991 |
| EP | 0994309 | 4/2000 |
| EP | 1589291 | 10/2005 |

* cited by examiner

OFFSET WEIGHT SUPPORTING SLIDE

This application is a divisional of U.S. application Ser. No. 12/200,035 filed on Aug. 28, 2008, now U.S. Pat. No. 8,182,056, which claims the benefit of U.S. Provisional Patent Application No. 60/970,047 filed on Sep. 5, 2007.

BACKGROUND OF THE INVENTION

The present invention relates generally to a shelf in a storage compartment, and more particularly, to an assembly for a cantilevered sliding shelf.

In the art of storage compartments for various appliances such as refrigerators, storage shelves can be cantilevered and attached to a single wall. It is desirable for such storage compartments, such as a bottom mount or a side mount refrigerator, to have shelves that slide in and out of the storage compartment when the shelves are attached to a single wall. However, a shelf that slides in and out of a refrigerator compartment that is cantilevered needs to have a proper structure to support larger items that are placed on the shelf and to prevent any deformation of the shelf.

Accordingly, a simple design for a cantilevered sliding shelf that can support various weights is desired.

BRIEF SUMMARY OF THE INVENTION

The following presents a simplified summary of the invention in order to provide a basic understanding of some example aspects of the invention. This summary is not an extensive overview of the invention. Moreover, this summary is not intended to identify critical elements of the invention nor delineate the scope of the invention. The sole purpose of the summary is to present some concepts of the invention in simplified form as a prelude to the more detailed description that is presented later.

In accordance with one aspect of the present invention, an appliance that includes a storage compartment is provided. The storage compartment includes a shelf within the storage compartment and a support apparatus configured for supporting the shelf on one side of the shelf. The support apparatus includes a first support, a second support, a first track surface, a second track surface, a third track surface, a first bearing, a second bearing, and a third bearing. The first support is configured to be attached to an interior wall of the storage compartment. The second support is configured to engage the first support. The first track surface, the second track surface, and the third track surface are each located on the first support. The first bearing is engaged with a portion of the second support where the first bearing is received in the first track surface. The second bearing is engaged with a portion of the second support where the second bearing is received in the second track surface. The third bearing is engaged with a portion of the second support where the third bearing is received in the third track surface. The shelf is attached to the second support of the support apparatus. The shelf and the second support are movable into a plurality of positions relative to the interior wall of the storage compartment by a movement of the shelf with respect to the first track surface, the second track surface, and the third track surface located on the first support.

In accordance with another aspect of the present invention, an appliance that includes a storage compartment is provided. The storage compartment includes a shelf within the storage compartment and a support apparatus configured for supporting the shelf on one side of the shelf. The support apparatus includes a first support, a second support, at least one track surface located on the first support, at least one bearing engaged with a portion of the second support, and an interlocking structure. The at least one bearing is received in the at least one track surface. The interlocking structure comprises a first locking protrusion and a first aperture on the second support and a second locking protrusion and a second aperture on the first support. The first locking protrusion engages the second aperture and the second locking protrusion engages the first aperture. The shelf is attached to the second support of the support apparatus. The shelf and the second support are movable into a plurality of positions relative to the interior wall of the storage compartment by a movement of the shelf with respect to the first track surface, the second track surface, and the third track surface located on the first support.

In accordance with another aspect of the present invention, a support apparatus is provided that is configured for supporting a shelf within a storage compartment of an appliance. The support apparatus includes an attachment structure, first support, a second support, a first track surface, a second track surface, a third track surface, a first bearing, a second bearing, and a third bearing. The attachment structure includes at least one mounting protrusion, where the at least one mounting protrusion is configured to engage an interior wall of the storage compartment. The first support is configured to engage the attachment structure. The second support is configured to engage the first support. The first track surface, the second track surface, and the third track surface are each located on the first support. The first bearing is attached to a portion of the second support where the first bearing is received in the first track surface. The second bearing is attached to a portion of the second support where the second bearing is received in the second track surface. The third bearing is attached to a portion of the second support where the third bearing is received in the third track surface. The shelf is attached to the second support of the support apparatus. The shelf and the second support are movable into a plurality of positions relative to the interior wall of the storage compartment by a movement of the shelf with respect to the first track surface, the second track surface, and the third track surface located on the first support.

BRIEF DESCRIPTION OF THE DRAWINGS

The foregoing and other aspects of the present invention will become apparent to those skilled in the art to which the present invention relates upon reading the following description with reference to the accompanying drawings, in which.

DESCRIPTION OF EXAMPLE EMBODIMENTS

Figure 1:
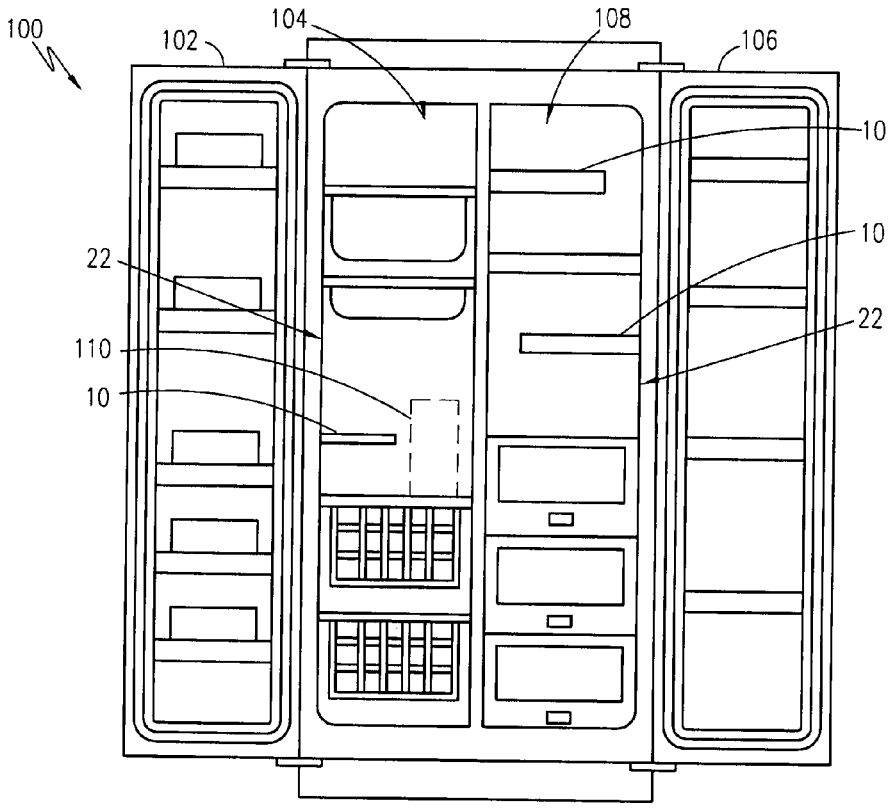
FIG. 1 is a front view of an example appliance that includes a storage compartment and a shelf.

Example embodiments that incorporate one or more aspects of the present invention are described and illustrated in the drawings. These illustrated examples are not intended to be a limitation on the present invention. For example, one or more aspects of the present invention can be utilized in other embodiments and even other types of devices. Moreover, certain terminology is used herein for convenience only and is not to be taken as a limitation on the present invention. Still further, in the drawings, the same reference numerals are employed for designating the same elements.

As shown in FIG. 1, an example appliance, a refrigerator 100, is shown that includes a shelf 10 of the subject invention. The refrigerator 100 includes a first door 102 which provides access to a freezer compartment 104. A second door 106 can provide access to a refrigerator compartment 108. The shelf 10 is configured to be cantilevered, such that the shelf 10 is only supported along one side within a storage compartment, such as the freezer compartment or the refrigerator compartment. The shelf 10 is configured for sliding in and out of each storage compartment. The shelf 10 has a support surface for supporting various objects, such as items that will be stored in a refrigerator. The shelf 10 is movable into a plurality of positions relative to the interior wall of the storage compartment. A shelf 10 is also shown near the top of a refrigerator compartment 108 and in the middle portion of the refrigerator compartment 108. Either storage compartment can be provided with at least one shelf 10 of the subject invention. For example, the shelf 10 can be mounted to an interior wall 22 of the freezer compartment 104. The shelf 10 in this example extends across a partial width of the freezer compartment, though it is appreciated that the width of the shelf can be varied in any of the example shelves 10. Accordingly, a taller object 110 can then still be placed in the area located underneath the shelf 10. The shelf 10 can also include structure to store objects from its underside. The shelf 10 can also include structure configured for storing objects on both the top and the underside of the shelf 10.

Figure 2:
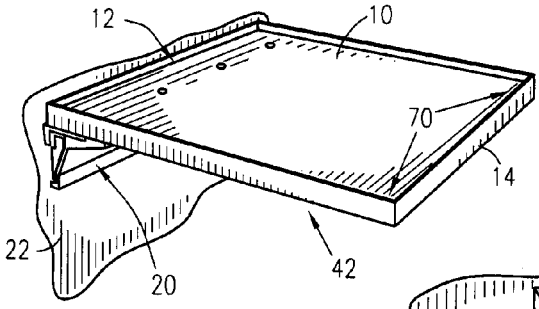
FIG. 2 is a perspective view of a first example support apparatus that includes the shelf of FIG. 1 where the shelf is in a first position.

In FIG. 2, a perspective view of a first example of the subject invention is shown. In the first example, a support apparatus 20 is provided that is configured for supporting the shelf 10 on a first side 12 of the shelf 10 within a storage compartment of an appliance. The support apparatus 20 is attached to a wall 22 which can be part of an interior of a storage compartment, such as the refrigerator shown in FIG. 1 or another appliance. The support apparatus 20 is configured to support the cantilevered shelf and to provide a sliding path for the shelf 10 in relation to the surface of the wall 22. The shelf 10 can extend horizontally along a portion of the storage compartment or it can extend horizontally across a substantial portion of the storage compartment. The shelf 10 can also have support surfaces that have different orientations, aside from horizontal. No matter the orientation of the support surface of the shelf 10 relative to the wall 22, the shelf 10 is only supported on a first side 12 of the shelf 10. A second side 14 of the shelf 10 is the side opposite the first side 12 supported by the support apparatus 20. The second side 14 of the shelf 10 is unsupported by the support apparatus 20. In FIG. 2, the shelf 10 is in a first position 42 which can be considered the starting position. The shelf 10 can be slidingly moved along the wall 22 to a second position 44, such as a forward position, shown in FIG. 3.

Figure 4:
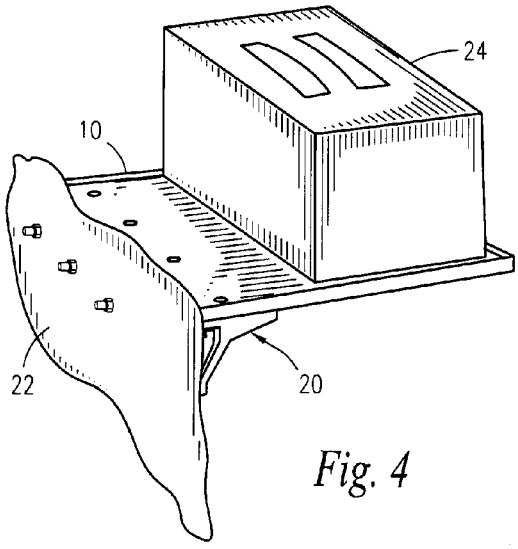
FIG. 4 is a perspective view of the first example support apparatus of FIG. 2 where the shelf has an item placed on it and the shelf is in a first position.

FIG. 4 illustrates an example object 24, which can be a plurality of water bottles full of water or other objects of substantial weight, which can be supported by the example shelf 10 provided with the support apparatus 20. The example shelf 10 provides an advantage in that the support apparatus 20 allows the shelf to support a relatively large amount of weight without a failure of the shelf 10. In addition, the shelf 10 is still capable of being slid into and out of the refrigerator compartment.

Figure 5:
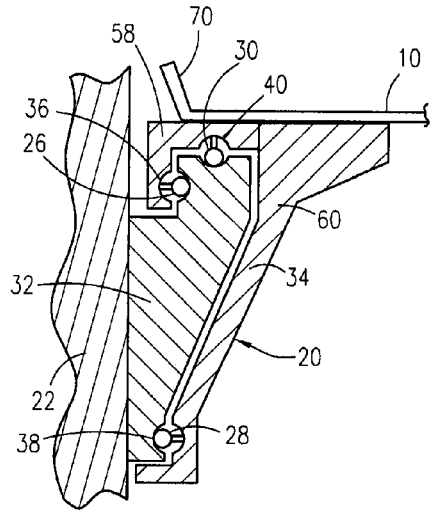
FIG. 5 is a front view of the first example support apparatus.

A front view of the first example support apparatus 20 is shown in FIG. 5. The support apparatus 20 in this example includes a first support 32 and a second support 34. The first support 32 and the second support 34 are both configured to support the shelf 10. The first support 32 in this example remains stationary as the first support is attached to the inside of an existing storage compartment or the wall 22 of a storage compartment. The first support 32 can be attached to the wall 22 through the use of fasteners in one example. The first support 32 in this example can include at least one track surface located on the first support 32. The at least one track surface can include a first track surface 36, a second track surface 38, and a third track surface 40. The first track surface 36, the second track surface 38, and the third track surface 40 are comprised of channels or indentations that are formed within the first support 32. The third track surface 40 is provided to help keep the forces centered that are exerted on the support apparatus 20.

The second support 34 has a generally complementary shape with the first support 32 as the second support 34 is configured to engage the first support 32. The second support 34, in this example, can include at least one bearing engaged with a portion of the second support 34 where the at least one bearing is received in the at least one track surface. The at least one bearing can include a first bearing 26, a second bearing 28, and a third bearing 30 engaged with different portions of the second support 34. The first bearing 26, the second bearing 28, and the third bearing 30 engage the first track surface 36, the second track surface 38, and the third track surface 40 of the first support 32. The track surfaces 36, 38, 40 in this example include circular indentations so that each track surface 36, 38, 40 is configured to support each bearing 26, 28, 30. It is appreciated that no indentations on the second support 34 are necessary, though in some example, each of the track surfaces 36, 38, 40 can be comprised of indentations on both the first support 32 and the second support 34. Thus, the bearings 26, 28, 30 that are engaged to the second support 34 are configured to be inserted into respective track surfaces 36, 38, 40 located on the first support 32. The insertion of the bearing 26, 28, 30 allows the second support 34 to engage the first support 32 for slidable movement of the second support 34 relative to the first support 32.

Figure 3:
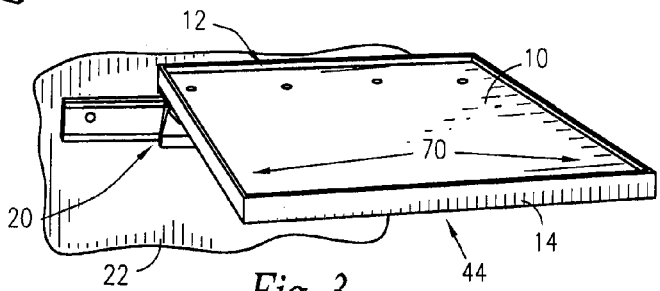
FIG. 3 is a perspective view of the first example support apparatus of FIG. 2 where the shelf is in a second position.

The second support 34 can also be configured to be attached to the shelf 10. In any of the examples, the shelf 10 can be part of a unitary structure extending from the second support 34 and the shelf 10 can have various kinds of structures, geometries, and orientations configured for the storage of various kinds of items. The shelf 10 and the second support 34 are movable into a plurality of positions relative to the interior wall of the storage compartment by a movement of the shelf 10 with respect to the first track surface 36, the second track surface 38, and the third track surface 40 that are located on the first support 32. As shown in the example of FIG. 3, the shelf 10 and the second support have been moved with respect to the first support 32.

The first support 32 and the second support 34 can each be single unitary pieces. Alternatively, it is also appreciated that the second support 34 and the first support 32 can each be manufactured from multiple pieces which can then be attached to each other by any conventional means, such as welding, gluing, fasteners, etc. The second support 34 can be comprised of multiple pieces and a weld, adhesive, or fastener can be used to attach together a first outer support 58 to a second outer support 60, as shown in FIG. 5. In other examples, different dimensions for the first support 32 and the second support 34 can be used. The engagement between the track surfaces 36, 38, 40 and the bearings 26, 28, 30 is configured to allow the shelf 10 to slide into multiple positions along the surface of the wall 22.

As shown in FIG. 5, the shelf 10 can further include a barrier 70 to prevent items from falling off the shelf 10. It is appreciated that a barrier 70 can be located along all of the outer edges of a support surface of the shelf 10, as seen in FIG. 2 and FIG. 3. The barriers 70 can be configured to prevent items from falling off the shelf 10 and can also prevent liquid from spilling off the shelf 10 into other areas of the storage compartment. It is appreciated that many different types of shelf structures can be used in conjunction with the support apparatus 20.

Figure 6:
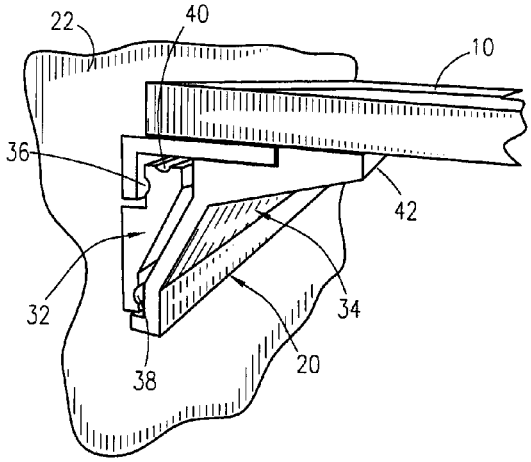
FIG. 6 is a perspective view of the first example support apparatus in a first position.
Figure 7:
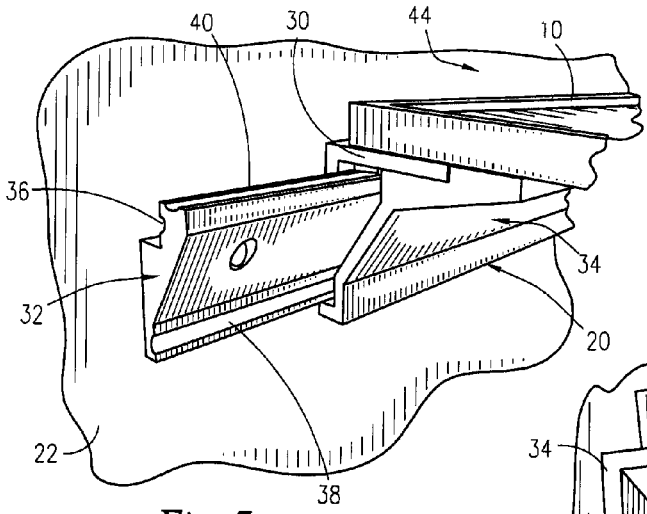
FIG. 7 is a perspective view of the first example support apparatus in a second position.
Figure 8:
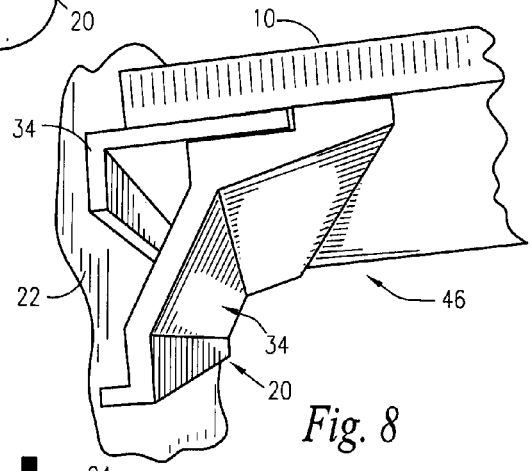
FIG. 8 is a perspective view of the first example support apparatus in a third position.

FIG. 6 illustrates the shelf 10 in the first position 42, and FIG. 7 illustrates the shelf 10 as it slides forwards in one direction into a second position 44 from the first position 42. FIG. 8 illustrates the shelf 10 if it was moved into a third position 46 from the first position 42. Accordingly, as shown, the shelf 10 can be moved from the first position 42 in a first direction to a second position 44. Alternatively, the shelf 10 can be moved in a second direction, opposite the first, from the first position 42 to the third position 46. Thus, the shelf 10 can slide into and out of the storage compartment in either direction, with objects 24 of various weights placed on top of the shelf 10. In one example, a user could push the shelf 10 into the back of a storage compartment and store taller items in front of the shelf 10.

Figure 9:
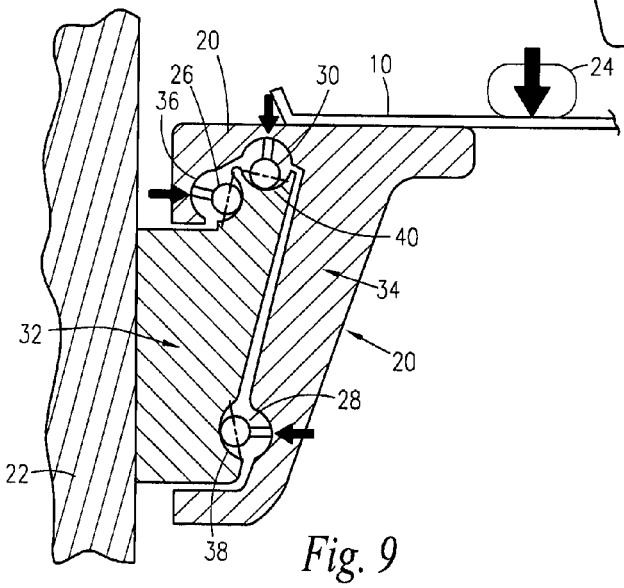
FIG. 9 is a front view of the first example support apparatus with an item placed on the shelf.

As shown in FIG. 9, the forces exerted on the bearings 26, 28, 30 between the first support 32 and the second support 34 are shown. The arrows represent the forces that are exerted on each bearing 26, 28, 30 based on the force an object 24 that is placed on the shelf 10 will exert on the support apparatus 20. Each of the bearings 26, 28, 30 is present to absorb the forces that the shelf 10 exerts on the support apparatus 20. The three track surfaces 36, 38, 40 and the three bearings 26, 28, 30 are provided to account for the large force that can be applied from an object 24 being placed on the shelf. The object 24 can be located at a horizontal distance from the support apparatus 20 such that a larger moment is created. The horizontal distance results in a first force pulling the first bearing 26 away from the wall 22 and a second force pushing the second bearing 28 towards the wall 22. The third bearing 30 is provided as an additional counter to the weight applied and to maintain the alignment of the support apparatus 20. The third bearing 30 can also provide stability for the shelf 10 by providing resultant forces in the horizontal direction. Without the third bearing 30, the entire support apparatus 20 is not as stable and is unlikely to be able to support as much weight.

In the example of FIG. 5 and FIG. 9, the third bearing 30 and the third track surface 40 can be located at a vertical distance above the first bearing 26 and the first track surface 36. The location of the third track surface 40 helps to provide additional stability for the shelf 10 as it is loaded with various objects, based on the various forces that are exerted by an object 24 placed on the shelf 10.

As shown best in FIG. 5, an orientation of the first track surface 36 can be defined by a normal of the first track surface that extends in a first direction from a tangent of the curved plane. A normal of the second track surface 38 can extend in a second direction parallel to the first direction of the normal of the first track surface 36. The second track surface can thus have an orientation that counteracts the forces that are applied at the first track surface 36. The third track surface 40 can have a normal that extends in a third direction. The third direction can be perpendicular to the first direction of the normal of the first track surface 36 and perpendicular to the second direction of the normal of the second track surface 38. In this example, the first track surface 36 has a normal extending in a direction to the left, the second track surface 38 has a normal extending in a direction to the right, and the third track surface 40 has a normal extending in a substantially vertical direction. Other orientations for the track surfaces can also be provided while still maintaining two parallel track surfaces and a third track surface being perpendicular. The third track surface 40 is perpendicular to the first track surface 36 and the second track surface 38 to help maintain the other two track surfaces in an aligned orientation and provide additional stability for the support apparatus 20.

Figure 10:
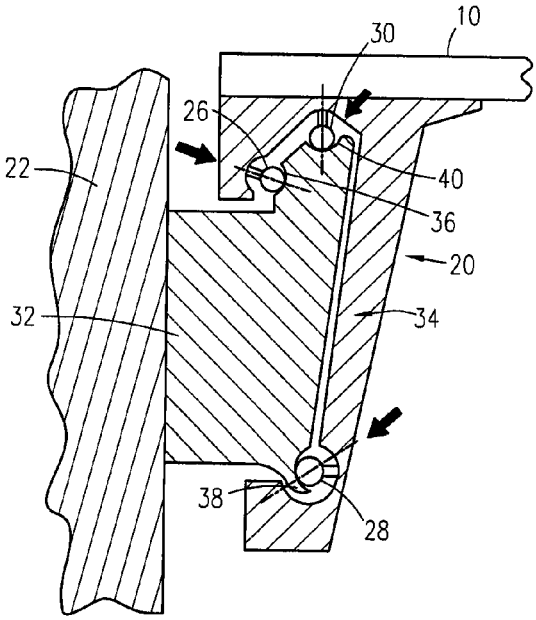
FIG. 10 is a front view of a second example support apparatus.

A second example of the subject invention is shown in FIG. 10. In FIG. 10, the first track surface 36 has a normal extending in a first direction diagonally to the upper left region, the second track surface 38 has a normal extending in a second direction diagonally to the upper right region, and the third track surface 40 has a normal extending in a third direction that is substantially vertical. In this example, the first track surface 36 and the second track surface 38 are neither parallel nor perpendicular to each other. Furthermore, the third track surface 40 is not perpendicular to either of the other orientations of the track surfaces or bearing channels. FIG. 10 illustrates how the third bearing 30 and the third track surface 40 helps to maintain the other track surfaces 36, 38 in a centered orientation, even when non-parallel and non-perpendicular orientations are provided between the first, second, and third track surfaces 36, 38, 40. In one example, both the first track surface 36 and the second track surface 38 are situated at the same angle relative to a horizontal line but with the first track surface 36 facing the left and the second track surface 38 facing the right. With the first track surface 36 and the second track surface 38 at the same angle, it is appreciated that the normal from the first track surface 36 has a horizontal component of a first force that can be opposite to the horizontal component of a second force that the second track 38 experiences. The third track surface 40 can be used to balance the vertical components of the forces that the first track surface 36 and the second track surface 38 are subjected to. Other orientations for the track surfaces 36, 38, 40 can also be provided.

Figure 11:
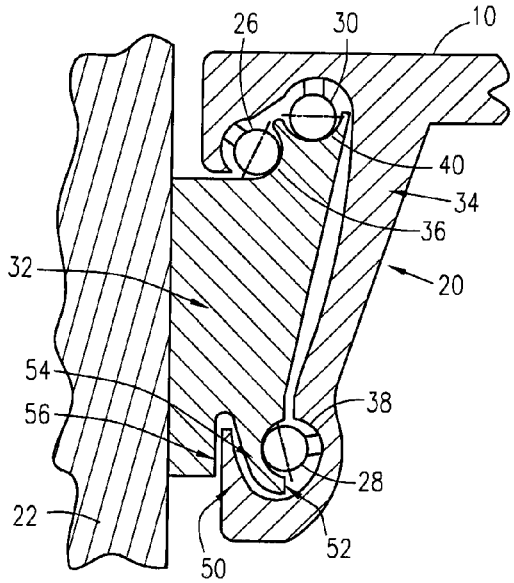
FIG. 11 is a front view of a third example support apparatus.

In FIG. 11, a third example of the support apparatus 20 is shown. In the third example, the first support 32 and the second support 34 are secured together through an interlocking structure. The interlocking structure includes a first locking protrusion 54 and a first aperture 56 on the first support 32. The interlocking structure further includes a second locking protrusion 50 on the second support 34. The interlocking structure can also include a second aperture 52 on the second support 34. The second locking protrusion 50 is configured to be received by the first aperture 56 located on the first support 32. Thus, a user can take the second support 34 and secure the second locking protrusion 50 into the first aperture 56 to improve the engagement between the second support 34 and the first support 32. In this example, the second support 34 relatively surrounds the first support 32 to provide additional engagement between the second support 34 and the first support 32, as the first locking protrusion 54 can also be secured into the second aperture 52. The size and orientations of the first locking protrusion 54, the second locking protrusion 50, the first aperture 56, and the second aperture 52 can also be varied.

Figure 12:
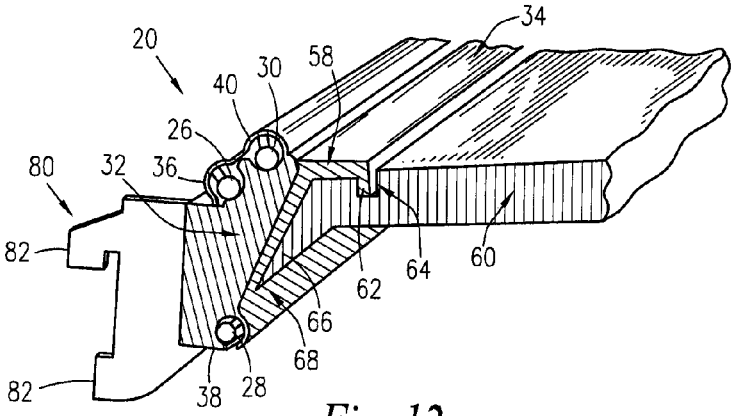
FIG. 12 is a front view of a fourth example support apparatus.

FIG. 12 illustrates a fourth example of the support apparatus 20. The support apparatus 20 includes an attachment structure 80 configured for assembling the support apparatus 20 into an existing storage compartment. The support apparatus 20 can be assembled into existing storage compartments, such as refrigerators, ovens, dishwashers, or other appliances for example. To retro-fit the support apparatus 20 and slidable shelf 10 into an existing storage compartment, the attachment structure 80 is provided. In this example attachment structure 80, at least one mounting protrusion 82 is configured to engage an interior wall of a storage compartment, such that the support apparatus 20 and shelf 10 can be installed in the storage compartment. In one example, the at least one mounting protrusion 82 can be provided for insertion into respective recesses located in the interior of an existing storage compartment. Other types of attachment structures 80 with varying types of protrusions and structure configured for engaging the interior of a storage compartment or a wall can be provided for securing the support apparatus into an existing storage compartment.

In other examples, the attachment structure 80 will not be provided, as the support apparatus 20 will be installed during the assembly of the storage compartment by use of welding, gluing, conventional fasteners, etc. or by the use of providing a first support 32 that is manufactured to be unitary with an inner wall of a storage compartment. It is appreciated that the attachment structure 80 can be provided with any of the other examples in the other Figures and is not limited to just the example of FIG. 12.

FIG. 12 further illustrates another example for the support apparatus 20. In this example support apparatus 20, the second support 34 includes multiple pieces that are interlocked and attached together. The second support 34 in this example includes a first outer support 58 and a second outer support 60 that interlocks and attaches to the first outer support 58. The first outer support 58 includes a first protrusion 62 that engages a corresponding recess 64 in the body of the second outer support 60. In this example, the first protrusion 62 extends downwardly into the recess 64 of the second outer support 60. Other orientations for the protrusion and the recess can also be used. Furthermore, in another example, a second protrusion 66 can be provided on the second outer support 60. The second protrusion 66 engages a corresponding second recess 68 on the first outer support 58. The second protrusion 66 is supported on multiple sides by the first outer support 58 in this example. The first protrusion 62 can be provided with or without the second protrusion 66 and the second protrusion 66 can be provided with or without the first protrusion 62. It is also appreciated that varying structures, geometries, and orientations can be used to form the protrusions 62, 66 and recesses 64, 68 for the outer support components 58, 60. Where at least one protrusion and at least one recess are present, the outer support components 58, 60 do not require any fastening means. In an alternative example, after the first outer support 58 and the second outer support 60 are in engagement, they can be further attached by any type of fastening means. In this example, the shelf 10 can be installed on top of the first outer support 58 and the second outer support 60. Alternatively, the second outer support 60 can be configured to support objects such as food items, such that the second outer support 60 is a shelf that is installed for sliding movement about the support apparatus 20.

The invention has been described with reference to the examples described above. Modifications and alterations will occur to others upon a reading and understanding of this specification. Examples incorporating one or more aspects of the invention are intended to include all such modifications and alterations insofar as they come within the scope of the appended claims.

What is claimed is:

1. A support apparatus supporting a shelf within a storage compartment of an appliance comprising:

an attachment structure that includes at least one mounting protrusion wherein the at least one mounting protrusion is configured to engage an interior wall of the storage compartment;

a first support configured to engage the attachment structure;

a second support configured to engage the first support;

a first track surface, a second track surface, and a third track surface each located on the first support;

a first bearing engaged with a portion of the second support wherein the first bearing is received in the first track surface;

a second bearing engaged with a portion of the second support wherein the second bearing is received in the second track surface;

a third bearing engaged with a portion of the second support wherein the third bearing is received in the third track surface;

wherein the shelf is attached to the second support of the support apparatus and the shelf is supported on one side of the shelf;

wherein a second side of the shelf is the side opposite a first side supported by the support apparatus, the second side of the shelf being unsupported by the support apparatus; and wherein the shelf and the second support are movable into a plurality of positions relative to the interior wall of the storage compartment by a movement of the shelf with respect to the first track surface, the second track surface, and the third track surface located on the first support.

2. The appliance according to claim 1, wherein the third track surface is located at a vertical distance above the first track surface.

3. The appliance according to claim 1, further comprising a barrier located on the outer edges of a support surface of the shelf, wherein the barrier is configured to prevent items from falling off the shelf and to prevent liquid from spilling off the shelf.

4. The appliance according to claim 1, wherein the shelf includes structure for storing objects on an underside of the shelf.

5. The appliance according to claim 1, wherein the second support is comprised of multiple pieces that are attached to each other.

6. The appliance according to claim 1, wherein the first bearing is subjected to a first force in a first direction that pulls the first bearing away from the interior wall; wherein the second bearing is subjected to a second force in a second direction opposite the first direction that pulls the second bearing towards the interior wall.

7. The appliance according to claim 1, wherein:

the first track surface has an orientation that includes a normal extending in a first direction;

the second track surface has a normal extending in a second direction that is parallel to the first direction; and the third track surface has a normal that extends in a third direction that is perpendicular to the first direction.

* * * * *